US005626487A

United States Patent [19]

Cheng et al.

[11] Patent Number: 5,626,487

[45] Date of Patent: May 6, 1997

[54] CONTACT FOR SLANTED SIMM SOCKET

[75] Inventors: Lee-Ming Cheng, Cupertino; Yu-Hsu Lin, Fremont, both of Calif.

[73] Assignee: Hon Hai Precision Ind. Co., Ltd., Taiwan

[21] Appl. No.: 383,088

[22] Filed: Feb. 3, 1995

[51] Int. Cl.[6] ..... H01R 13/62

[52] U.S. Cl. ..... 439/326

[58] Field of Search ..... 439/59–62, 326–329, 439/629–637

[56] References Cited

U.S. PATENT DOCUMENTS

| | | | |
|---|---|---|---|
| 4,957,448 | 9/1990 | Stanevich et al. | 439/326 |
| 5,085,593 | 2/1992 | Tuan | 439/326 |
| 5,100,338 | 3/1992 | Lu | 439/326 |
| 5,401,182 | 3/1995 | McHugh et al. | 439/326 |

*Primary Examiner*—Khiem Nguyen

[57] ABSTRACT

An electrical contact (30) for use with an elongated slanted SIMM socket, includes a base (32), a pair of retention arms (34, 35) respectively positioned at two opposite ends thereof, and a tail (36) extending therefrom for solderably connecting to a PC board on which the socket (80) is mounted. A pair of cantilever type contact beams (36, 38) generally extending from one corner (42) formed by one of the retention arms (34, 35) and the base (32), are composed of a high beam (36) and a low beam (38) wherein a contact apex (46) of the high beam (36) engages the corresponding pad (104) on the upper surface (106) of the module (100), and a contact apex (54) of the low beam (36) engages the corresponding pad (108) on the undersurface (109) of the module (100). The high beam (36) includes at least two segments (40, 44) whereby a substantial component of a displacement of the contact apex (46) of the high beam (36) along the upper surface (106) of the module (100) is arranged in a direction from the lower edge to the upper edge of the module (100).

11 Claims, 6 Drawing Sheets

CONTACT FOR SLANTED SIMM SOCKET

BACKGROUND OF THE INVENTION

1. Field of The Invention

The invention relates to contacts for use with SIMM sockets, particular to stamped contacts within a slanted SIMM socket which should keep a low profile and minimum space on a PC board on which the SIMM is mounted.

2. The Prior Art

SIMMs (Single In-line Memory Modules) are popularly used in the recent computer industry, and therefore the SIMM sockets are also commonly designed for receiving such SIMMs therein for signal transmission between such modules and the PC board on which such sockets are mounted. The contacts for use within the SIMM sockets can vary in different ways as shown in U.S. Nos. 4,737,120, 4,984,996, 4,998,890, 5,013,257, 5,015,194, 5,041,005, 5,061,200, 5,064,381, 5,076,804, 5,080,602, 5,085,593, 5,100,337, 5,116,237 and 5,199,895.

As well known, the dimension of the computer set becomes tinier and tinier, and it means that the lay-out (i.e., the horizontal dimension), and the height (i.e., the vertical dimension) of the socket should keep as minimum as possible in the design. To minimize the horizontal and vertical dimensions of the socket, the width and the height of the socket are reduced and thus the inside corresponding cavity for receiving the contact is substantially smaller than that in the previous regular one. That is to say that the space for the contact beam(s) design is getting more and more critical to have a minimum normal force thereof with regard to the corresponding inserted module under such a small dimension. Furthermore, to minimize the vertical dimension of the whole assembly (including the module and the socket) as the module is received within the socket, the slanted type SIMM sockets are popularly used for allowing the inserted module lying slopingly therein. The slanted type SIMM socket can be referred to U.S. Pat. Nos. 5,013,157, 5,041,005, 5,064,381, 5,085,593, 5,100,337, 5,116,237 and 5,174,780. In the fact, to reduce the height to a maximum limit, the angle of the slanted type SIMM socket with regard to the PC board on which the socket is mounted, is designedly arranged to be smaller than before, for example, the angle being from 40° C. as shown in aforementioned U.S. Pat. No. 5,366,390 to 22.5° C. described in the present invention.

As noted, the SIMM socket is design to have the module inserted in a first position for the zero insertion force, and further rotated in a second position for the required normal force. The tinier and/or more slanted the socket is, the tougher such electrical and mechanical connection applications of the module in the socket are. This is because several limitations should be applied thereto. As shown in FIGS. 1 and 1(A), the stamped contact 10 in the cavity 11 of the slanted SIMM socket 12 generally includes a pair of contact beams 13, 14 (i.e., the high beam and the low beam) for sandwiching the module 17 therebetween wherein the high beam 13 engages the pads 15 on the top surface 16 of the inserted module 17, and the low beam 14 engages the pads 18 on the undersurface 19 of the module 17. First, the distance S between the contact apexes 20, 21 of the contact beams 13, 14 should be sufficiently large, at least beyond the thickness of the module 17, for allowing zero insertion force of the module in the slot 22 of the socket 12 (i.e., the first position), but also be sufficiently small for allowing the minimum required normal force occurring when the module 17 is successively rotated to mechanically and electrically engage the corresponding pair of contact beams 13, 14 (i.e., in the second position). Basically, it is uneasy to achieve this issue in a tiny slanted SIMM socket.

Secondly, the contact apexes 20, 21 of the contact beams 13, 14 tend to substantially move in opposite directions with each other when the module is rotated from the first position to the second position. Such opposite movements includes the opposite movements along the surfaces of the module 17 in the directions from the top (bottom) edge of the module to the bottom (top) edge of the module. In other words, as shown in FIG. I(A), the contact apex 20 of the high beam 13 moves to the bottom edge of the module in the direction A, but the contact apex 21 of the low beam 14 moves to the top edge of the module in the direction B. Obviously, such opposite movements almost have the corresponding contact apexes 20, 21 located outside of the electrical pads 15, 18 on the module 17, i.e., the contact apex 20 of the high beam 13 being located adjacent the lower edge of the pad 15 on the top surface 16 of the module 17 and the contact apex 21 of the low beam 14 being located adjacent the upper edge of the pad 18 on the undersurface 19 of the module 17, even though such apex 15, 18 are generally facing the center portion of the corresponding pads 20, 21 when the module 17 is in the first position. Such bad positioning of the contact apexes 20, 21 to the pads 15, 18, will result in poor mechanical and electrical engagement of the contact 10 with the module 17, and the unexpected intermittence in data communication thereof. Using a big head type contact apex for not dropping out of the corresponding pad may resolve this problem, but it will decrease the required minimum distance S between the contact apexes 20, 21 and substantially jeopardize the normal insertion force arrangement. Differently, changing the shape of the contact beam to reduce the deflection of the contact beam and have the contact apex be in a smaller displacement for not dropping out of the corresponding pad, may solve this problem, too, but it will also jeopardize the minimum required normal force which is originally designed for engagement between the module and the contact apexes.

Therefore, an object of the invention is to provide specifically configured contacts for use with a slanted SIMM socket, wherein the contact apexes of the contact beams can not only provide a sufficient space therebetween to permit zero insertion force of the module, but also be located as much within the range of the corresponding pad as possible to achieve a reliable good electrical data transmission between the module and the socket.

SUMMARY OF THE INVENTION

According to an aspect of the invention, an electrical contact for use with an elongated slanted SIMM socket, includes a base, a pair of retention arms respectively positioned at two opposite ends thereof, and a tail extending therefrom for solderably connecting to a PC board on which the socket is mounted. A pair of cantilever type contact beams generally extending from one corner formed by one of the retention arms and the base, are composed of a high beam and a low beam wherein a contact apex of the high beam engages the corresponding pad on the upper surface of the module, and a contact apex of the low beam engages the corresponding pad on the undersurface of the module. The high beam includes at least two segments whereby a substantial component of a displacement of the contact apex of the high beam along the upper surface of the module is arranged in a direction from the lower edge to the upper edge of the module.

BRIEF DESCRIPTION OF THE DRAWINGS

FIG. 1(A) is a cross-sectional view of a slanted SIMM socket enclosing the contact of FIG.1.

FIG. 3(A) is a cross-sectional view of the 22.5° C. SIMM socket of FIG. 2(A) including the contact of FIG. 1 without a module inserted therein.

DETAILED DESCRIPTION OF THE PREFERRED EMBODIMENT

References will now be made in detail to the preferred embodiments of the invention. While the present invention has been described with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
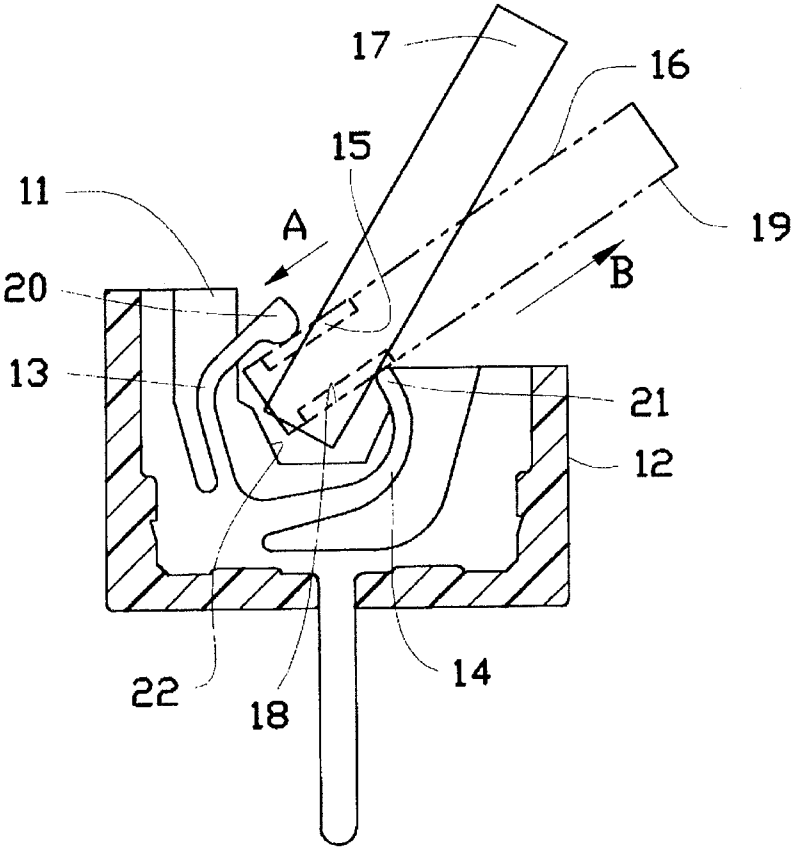
FIG.1 (A) PRIOR ART
FIG. 1 is a plan view of a contact of the prior art.
Figure 1:
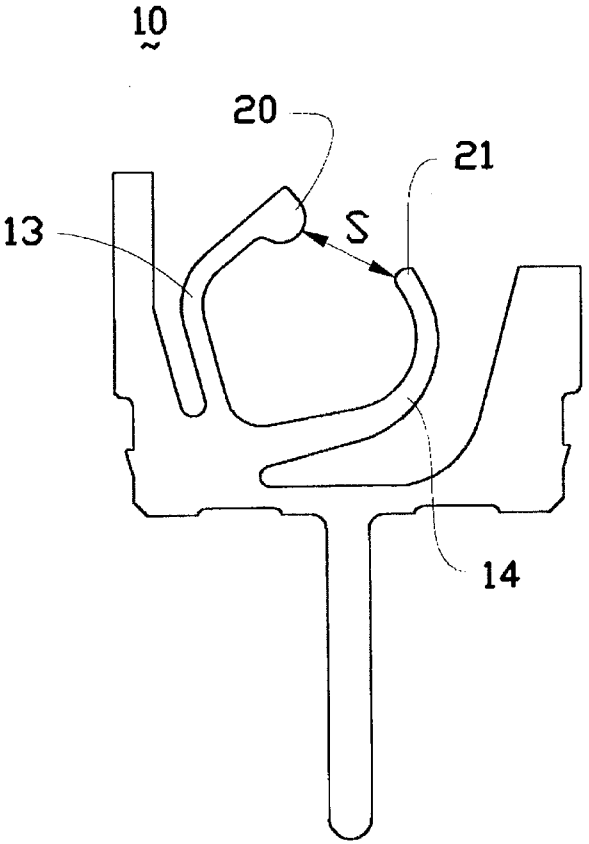
FIG.1 PRIOR ART
Figure 2:
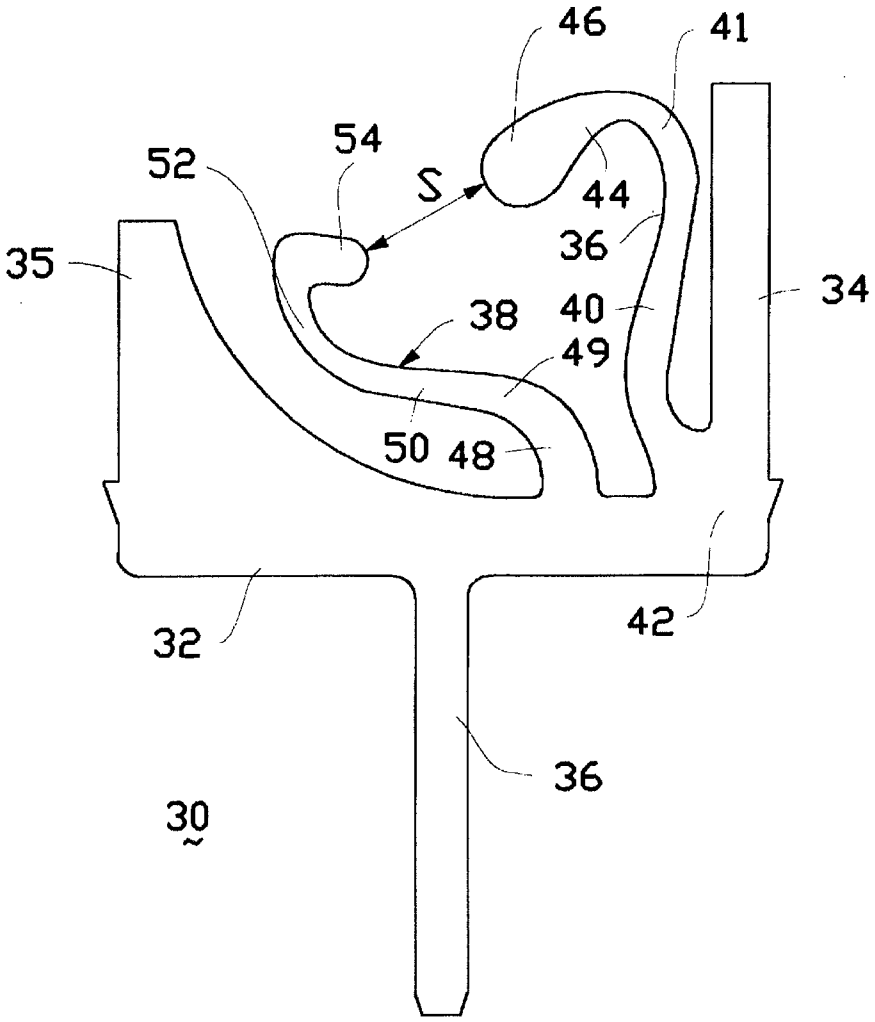
FIG. 2 is a plan view of an electrical contact for use with a 22.5° C. SIMM socket according to the invention.
Figure 3:
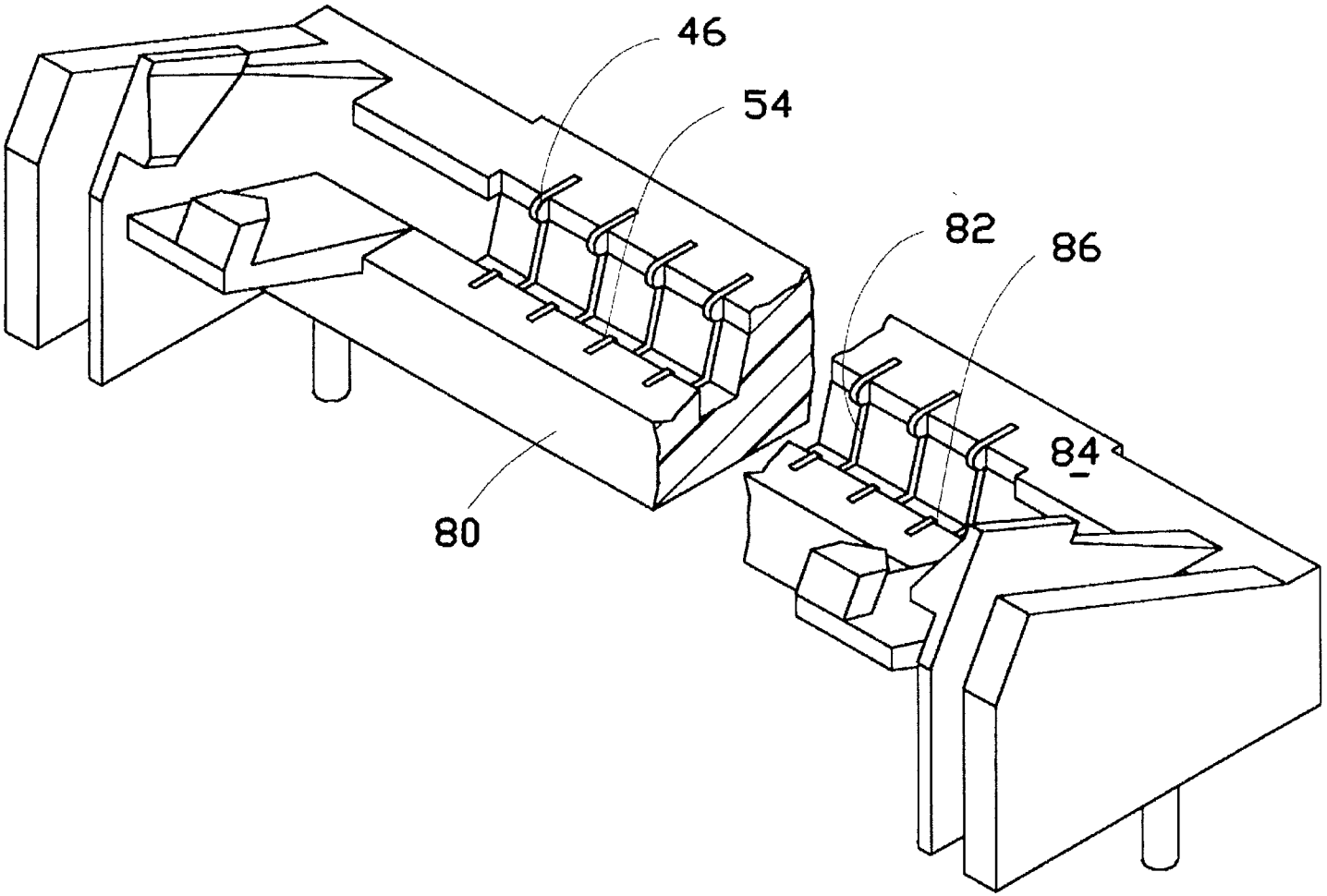
FIG. 3 is a perspective view of a 22.5° C. SIMM socket including the contact of FIG. 1.
Figure 3:
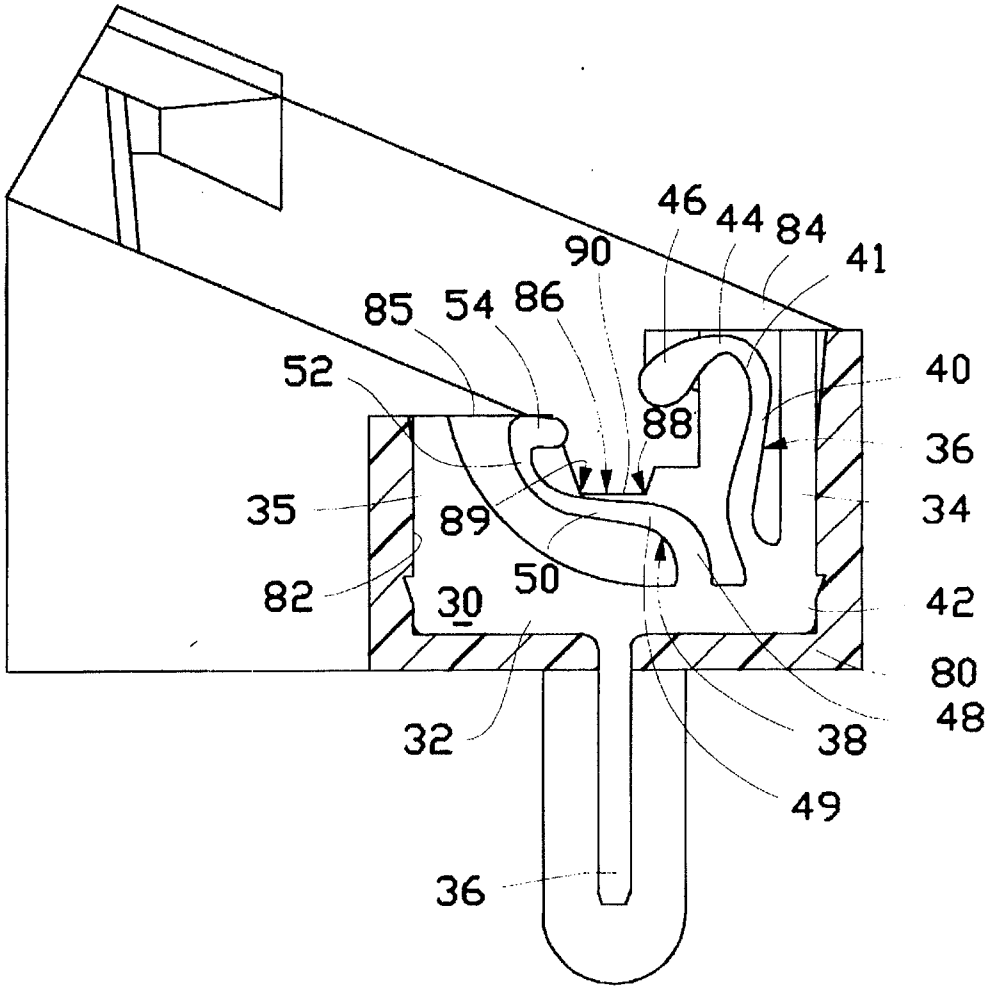

It will be noted here that for a better understanding, most of like components are designated by like reference numerals throughout the various figures in the embodiments. Attention is now directed to FIGS. 2, 3 and 3(A) wherein a contact 30 includes a horizontal base 32, and a pair of retention arms 34, 35 respectively extending upward from two opposite ends thereof. The retention arm 34 (35) has barbs at the edge for interferential engagement within a corresponding cavity 82 in a slanted SIMM socket 80 wherein the contact 30 is generally received within the cavity 82.

A mounting tail 36 extends downward from the base 32 for soldering in a through hole in a PC board (not shown) on which the socket 80 is mounted. To comply with the configuration of the socket 80 and its application with the module 100 (see FIG. 4(A)) inserted therein, the contact 30 includes two contact beams 36, 38 wherein the high beam 36 includes a first segment 40 integrally extending upward from a corner 42 formed by the high retention arm 34 and the base 32. The first segment 40 extends generally vertically and stops adjacent the first top surface 84. A second segment 44 integrally extends from the upper end 41 of the first segment 40 toward the center slot 86 in the socket 80 wherein the lower edge portion 102 of the module 100 (FIGS. 4(A), 4(B)) is received within the slot 86 for engagement with the contacts 30. The second segment 44 substantially extends toward the center slot 86 in a downward slope whereby a contact apex portion 46 at the end of the second segment 44 is substantially positioned lower than the end 41 of the first segment 40.

The low beam 38 includes a first section 48, a second section 50 and a third section 52 wherein the first section 48 directly extends upward and slopingly from the base 32 adjacent to the joint of the high beam 36 and the base 32 toward the center slot 86, and stops adjacent the first corner 88 of the slot 86. The first section 48 generally forms curvature which is convex with regard to the base 32. The second section 50 extends from the top end 49 of the first section 48, in generally a horizontal direction parallel to the bottom surface 90 of the slot 86, toward the low retention arm 35, and stops at adjacent the second corner 89 of the slot 86. The third section 52 successively and continuously upward extends from the distal end of the second section 50 in a concave configuration with regard to the base 32, and stops adjacent the second surface 85 of the socket 80. A contact apex portion 54 is formed at the end of the third section 52 of the low beam 36.

Both contact apex portions 46, 54 of the high beam 36 and lower beam 38 project into the central slot 86 in the socket 80 and face to each other, whereby a receiving distance S is defined therebetween which is sufficiently large to permit zero insertion force of the module 100 when it is in a first position as shown in FIG. 3(A). It can be noted that the space for designing the high beam 36 of the contact 30 to meet the requirements of zero insertion force and sufficient normal force thereof with regard to the inserted module 100, is obviously much smaller and more critical than that for the low beam 38. Therefore, the generally vertical first segment 40 and the successively downward slanted second segment 44 is really a only one preferred solution to meet such requirements. The reason why such configurations of the contact 30 can avoid the aforementioned problems in the prior arts, is illustrated as follows.

Figure 4:
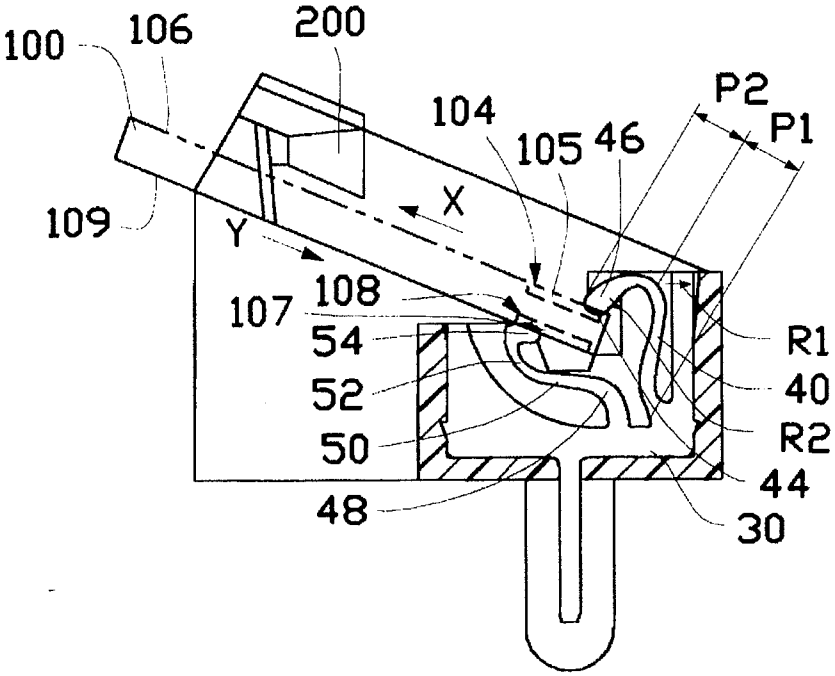
FIG. 4(A) is a cross-sectional view of the 22.5° C. SIMM socket to show an imaginary module in the first position for zero insertion force.
FIG. 4(B) is a cross-sectional view of the 22.5° C. SIMM socket to show the imaginary module in the second position for illustrating the relationship between the contact beam and the module in the second position.
Figure 4:
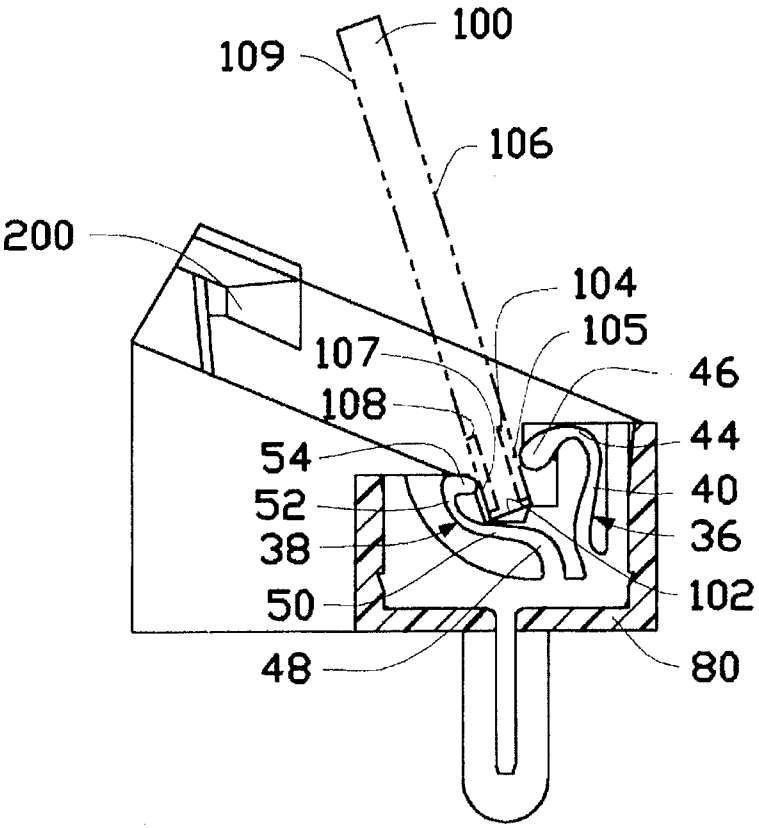
Figure 5:
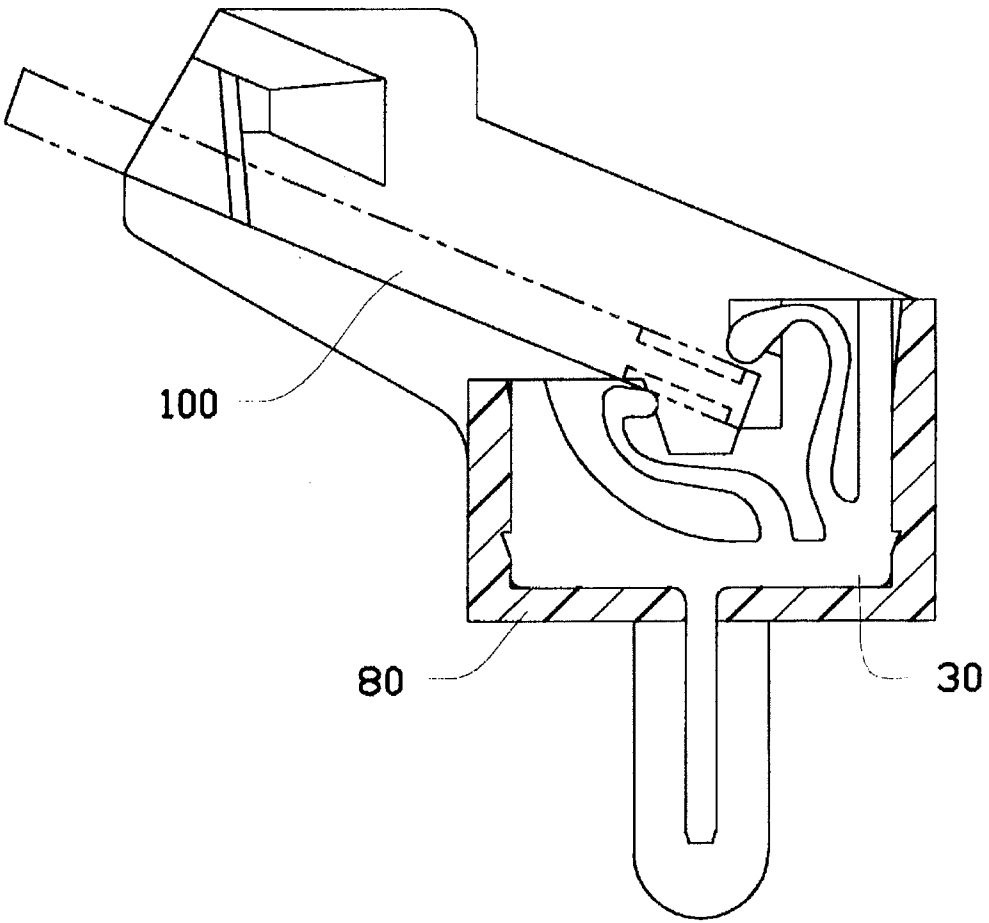
FIG. 5 is a cross-sectional view of the 22.5° C. SIMM socket having a module maintained therein to show the final positions of the contact beams of the contact therein when the module is in its fixed position.

As shown in FIGS. 4(A), 4(B) and 5, after the module 100 is rotated from the first (initial insertion) position and to the second (final fixed) position, the contact apex portion 46 of the high beam 36 is moved from its original position due to its engagement with the module 100. This movement or displacement is generally reflectively based on the deflection of whole length of the high beam 36. As described before, when the engagement between the module 100 and the contact 30 occurs, the contact apex portion 46 is expected to move toward the mid-portion 105 of the corresponding pad 104 in the direction as marked by arrow X for avoiding dropping out of the pad region (i.e., being positioned below the lower edge of the corresponding pad 104 on the upper surface 106 of the module 100). As a result, this expectation can be achieved in this preferred embodiment. In detailed analysis, when the whole high beam 36 is deflected, the first segment 40 tends to have a movement as marked by arrow R1 which can result in a component opposite to the direction X, and this movement can be deemed as a negative factor to the expectation. Oppositely, the second segment 44 tends to have a movement as marked by arrow R2 which can result in a component along the direction X, and this movement can be deemed as a positive factor to the expectation. The first movement component of the first segment 40 plus the second movement component of the second component segment 44 of the high beam 36 can obtain the true displacement of the contact apex portion 46 of the high beam 36. In this embodiment, because the first component of the first segment 40 is generally equal to the second component of the second segment 44, the contact apex portion 46 eventually can expectedly stay within the pad region that is good for the reliable engagement with the module 100. The reason is that the first (second) component of the first (second) segment 40, (44) is proportional to the projection p1, (p2) of the first (second) segment 40, (44) on the upper surface 106 of the module 100, so that the longer the projection is, the larger the component is. It can be appreciated that in other embodiment, the positive component of second segment 44 may be designedly arranged to be substantially larger than the negative component of the first segment 40 by arrangement of a longer projection p2 of the second segment 44 than of the first segment 40, if the other consideration such as the limited space, the zero insertion force and the sufficient normal force, can be satisfied.

Similarly, in the low beam 38 of the contact 30, the first section 48 and the third section 52 provide components which are negative factors with regard to the direction Y that is facing toward the mid-portion 107 of the pad 108 on the under-surface 109 of the module 100 for the contact apex portion 54 of the low beam 38. Oppositely, the second section 50 provides component having good factor for movement in the direction Y. In this embodiment, because the component of the second section 50 is somewhat equal to the sum of the components of the first and the third sections 48, 52 so that the contact apex portion 54 of the low beam 38 are eventually still controllably located within the region of the corresponding pad 108 when the module 100 is rotated in the second position and the low beam 38 is deflected thereof. Certainly, like the high beam 36, the low beam 38 can be designedly arranged to have the sum of the components, which is generated by sections of the whole length of the low beam 38, be positive to the movement along the direction Y, thus assuring the good engagement between the low beam 38 and the module 100.

The reason why it is important to have the contact apex portion be located within the pad region of the module in the SIMM socket, is that the module 100 therein has to rotate from the first position to the second position for zero insertion force consideration, and that is much totally different from the vertical insertion of the module used in a conventional card edge connector. Understandably, the contact apex portions of the pair of contact beams at two sides of the module should be positioned at different levels to the module with each other (i.e., one being higher than the other) for generating a rotation moment to let the module rotated from the second position back to the first position after the latches 200 of socket 100 have be released. In contrast, the contact for use within the conventional card edge connector as shown in U.S. Pat. No. 4,913,270, generally has a pair of contact beams symmetrically positioned at two sides of the vertically inserted module at the substantial same level with regard to the module for consideration of proper balance, and naturally the contact apex of each beam can easily controllably arranged close to the mid-portion of the corresponding pad for good mechanical and electrical engagement. Therefore, in the SIMM socket, especially in a slanted type SIMM socket, the opposite contact apex portions of such a pair of contact beams are substantially designedly required to be positioned respectively in a lower portion of the pad on the top surface and in an upper portion of the pad on the undersurface of the module when the module is rotated to a second position, even though the module can be inserted into the space defined by the distance S between two contact apex portions of the beams under zero insertion force and in the first position wherein the opposite apex portions are respectively generally facing to the mid-portions of the corresponding pads on two opposite surfaces of the module. In conclusion, the spirit of the invention is to have the contact apex portion of each beam move toward the mid-portion of the pad (at least not moving away from the pad) when the module is rotated to the second position, the engagement between the module and the contact occurs, the deflection of the beam takes place, and the displacement of the contact apex portion starts, for assuring that the contact apex portions of the beams are substantially located within the region of the corresponding pads and the reliable electrical engagement maintains thereof. The spirit of the invention becomes more important when the minimization and the slanted type of the SIMM socket are applied in the recent years.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims.

What is claimed is:

1. A contact for use with a slanted SIMM socket, comprising:

an elongated base for reception within a corresponding cavity in the socket;

a tail integrally extending from the base for mounting on a PC board on which the socket is mounted; and a pair of contact beams extending upward from a corner of the base, said contact beams including a high beam and a low beam wherein the high beam has less space to be configured in comparison with the low beam, each beam having contact apex portion thereof for engagement with a corresponding pad on a module inserted into the socket, and the contact apex portions of said pair of beams defining a distance therebetween for allowing zero insertion force of the module in a first position, at least one beam being composed of segments which generate an accumulative component, to its contact apex portion, along a surface of said module for not moving away from the corresponding pad on the module and assuring a reliable mechanical and electrical engagement between said contact apex portion and said pad when the module is rotated to a second position, said beam is deflected, and displacement of said contact apex portion occurs, accordingly.

2. The contact as described in claim 1, wherein said contact further includes a pair of retention arms extending upward from two opposite ends of the base.

3. The contact as described in claim 1, wherein said high beam including a first segment generally extending from adjacent one end of the base vertically and stopping adjacent a first top surface of the socket, and a second segment integrally extending from a top portion of the first segment downward and slopingly toward a center slot of the socket into which the module is inserted.

4. The contact as described in claim 1, wherein said low beam including a first section, a second section and a third section, said first section directly extending upward and slopingly from the base adjacent to a joint of the high beam and the base toward a center slot of the socket into which the module is inserted, and stopping adjacent a first corner of the slot, said first section generally forming curvature which is convex with regard to the base, said second section extending from a top end of the first section, in generally a horizontal direction parallel to a bottom surface of the slot, toward the retention arm opposite to the high beam, and stopping at adjacent a second corner of the slot, the third section successively and continuously upward extends from a distal end of the second section in a concave configuration with regard to the base, and stopping adjacent a second surface of the socket.

5. The contact as described in claim 3, wherein the first segment having a first projection along a top surface of the inserted module, said first projection resulting in a negative component for movement of the contact apex portion of the high beam toward the corresponding pad, and the second segment having a second projection along the same top surface of the inserted module, said second projection resulting in a positive component for movement of the contact apex portion of the high beam toward the same corresponding pad, and said first projection being somewhat equal to the second projection so that the contact apex portion of the high beam can be maintained in a region of the corresponding pad when the module is rotated to be engaged with the contact and the beam of the contact is deflected.

6. The contact as described in claim 4, wherein each section has its own projection along an undersurface of the module, and a sum of components proportional to said projections is close to zero, so that the contact apex portion of the low beam can be maintained in a region of the corresponding pad when the module is engaged with the contact and the beam of the contact is deflected.

7. An electrical SIMM connector for use with a module (100) wherein said module (100) can be inserted into the connector in a first initial position for zero insertion force and later be rotated to a second fixed position for sufficient normal force thereof, comprising:

an elongated socket (80) having a slot (86) for receiving said module (100) therein; and a plurality of contacts (30) positioned on two sides of said slot (86) for engagement with a plurality of corresponding pads 104, 108) positioned on two opposite surfaces (106, 109) of said module (100);

each contact (30) including a pair of high and low beams (36, 38) each having a contact apex portion (46, 54) for defining a distance (S) therebetween for allowing zero insertion force when the module (100) is inserted into the socket (80) in the first position, said pair of contact apex portions (46, 54) respectively positioned on two opposite pads (104, 108) on two opposite surfaces (106, 109) of the module (100) at different levels with regard to the module (100) in the second position wherein one (54) is positioned adjacent a top edge of the corresponding pad (108), and the other (46) is positioned adjacent a bottom edge of another corresponding pad (104), so that a rotation moment is formed thereof for tendency of moving the module (100) from the second position back to the first position, the high beam (36) including segments (40, 44) which generate an integrated component having the corresponding contact apex portion (46) displaced somewhat in a direction (Y) toward a bottom edge of the module (100) when the module (100) is in the second position and the beam (36) is deflected.

8. The connector as described in claim 7, wherein said contact is of a cantilever type and the contact apex portion is positioned at its top.

9. The connector as described in claim 7, wherein said socket is of a slanted type.

10. A connector for use with a module adapted to be rotatably inserted within the connector, comprising:

a slanted SIMM socket for receiving a plurality of stamped contacts side by side positioned therein;

each contact having a base, retention means for maintaining the contact in position, a tail for mounting on a PC board on which the connector is seated, a high contact beam and a low contact beam each including curvature composed of at least two successive segments directing to different directions wherein an integrated component accumulated along said contact beam actuates a contact apex portion of the contact beam to move toward a mid-portion of a corresponding pad on a surface of the module when said module is in its fixed position.

11. The connector as described in claim 10, wherein said contact beam is composed of segments and each segment has a projection along the surface of the module, whereby a sum of the projections of the corresponding segments providing positive components in compliance with the movement of the contact apex portion toward the mid-portion of the pad, is substantially larger than that of the projections of the corresponding segments providing negative components opposite to said movement of the contact apex portion.

* * * * *